US006994146B2

(12) United States Patent
Wang

(10) Patent No.: US 6,994,146 B2
(45) Date of Patent: Feb. 7, 2006

(54) ELECTROMAGNETIC DIE CASTING

(76) Inventor: Shaupoh Wang, 104 Brighthurse Dr., Chesterfield, MO (US) 63005

( * ) Notice: Subject to any disclaimer, the term of this patent is extended or adjusted under 35 U.S.C. 154(b) by 0 days.

(21) Appl. No.: 10/293,778

(22) Filed: Nov. 12, 2002

(65) Prior Publication Data

US 2004/0089435 A1 May 13, 2004

(51) Int. Cl.
*B22D 17/00* (2006.01)
*B22D 27/02* (2006.01)

(52) U.S. Cl. ..... 164/113; 164/312; 164/499

(58) Field of Classification Search ..... 164/113, 164/312, 900, 498, 499, 147.1
See application file for complete search history.

(56) References Cited

U.S. PATENT DOCUMENTS

| | | | | | |
|---|---|---|---|---|---|
| 2,861,302 | A | | 11/1958 | Mann et al. | |
| 2,877,525 | A | | 3/1959 | Schaaber | |
| 3,467,166 | A | | 9/1969 | Getselev | |
| 3,693,697 | A | | 9/1972 | Tzavaras | |
| 4,229,210 | A | * | 10/1980 | Winter et al. | 75/10.14 |
| 4,321,958 | A | | 3/1982 | Delassus | |
| 4,434,837 | A | | 3/1984 | Winter et al. | |
| 4,457,354 | A | * | 7/1984 | Dantzig et al. | 164/468 |
| 4,561,489 | A | * | 12/1985 | Dantzig et al. | 164/467 |
| 4,645,534 | A | | 2/1987 | D'Angelo et al. | |
| 4,678,024 | A | * | 7/1987 | Hull et al. | 164/503 |
| 4,776,767 | A | | 10/1988 | Motomura | |
| 4,789,020 | A | * | 12/1988 | Motomura | 164/147.1 |
| 4,986,340 | A | | 1/1991 | Eriksson | |
| 5,195,572 | A | * | 3/1993 | Linden et al. | 164/312 |
| 5,579,825 | A | * | 12/1996 | Shibata et al. | 164/493 |
| 5,718,280 | A | * | 2/1998 | Matsuura et al. | 164/498 |
| 6,135,196 | A | | 10/2000 | Kono | |
| 6,165,411 | A | | 12/2000 | Adachi et al. | |
| 6,427,754 | B1 | * | 8/2002 | Ozcan | 164/95 |
| 6,478,075 | B1 | * | 11/2002 | Shibata et al. | 164/113 |

FOREIGN PATENT DOCUMENTS

| | | | |
|---|---|---|---|
| JP | 51-12328 | * | 1/1976 |
| JP | 61-119368 | * | 6/1986 |

OTHER PUBLICATIONS

WO 01/91945, May 21, 2001, Production of On-Demand Semi-Solid Material for Castings Norville, Samuel Lombard, Patrick Lu, Jian Wang, Shaupoh.

* cited by examiner

*Primary Examiner*—Kevin P. Kerns
(74) *Attorney, Agent, or Firm*—Paul M. Denk

(57) ABSTRACT

A die-casting method and a device for use in the die-casting method are disclosed. The casting material, which can be liquid metal, semi-solid metal or metal-matrix composite, in the shot chamber of a die-casting machine is driven to flow with high shear rate to mix homogeneously by the electromotive force induced with at least one low-frequency shifting electromagnetic field. The temperature and the microstructure of the casting material near the shot chamber are further controlled and perturbed by at least one high-frequency electromagnetic field to minimize the temperature difference or the growth of dendritic microstructure. To ensure the efficiency of the electromagnetic fields, the shot chamber is made of non-magnetic material and its wall thickness is less than three times the penetration depth of the electromagnetic fields. The shot chamber is surrounded by at least one solenoid coil, a conducting shield and at least one electric motor stator. The conducting shield, which only allows the low-frequency electromagnetic field to penetrate, protects the stator from being overheated by the high-frequency electromagnetic field.

21 Claims, 5 Drawing Sheets

ELECTROMAGNETIC DIE CASTING

BACKGROUND OF THE INVENTION

The invention relates to a method of casting metallic parts and to a device for use in the casting method. More specifically, the present invention relates to a method and a device to homogenize, to improve the microstructure and to control the temperature of casting material in a casting process.

High-pressure die casting (HPDC) is a process in which liquid alloy is injected from a prep device, known as a "shot chamber", into part cavities in a mold at high speed and high pressure. Because of its short cycle time, near net shape and capability for making multiple parts in one shot, HPDC is one of the most economic processes to produce high-volume alloy products. However, HPDC products often contain defects, e.g. porosity, oxide inclusion and cold shot, which are not acceptable for applications that require high strength or leak tightness.

Squeeze casting is an improvement of HPDC where the mold is maintained at higher temperature and the molten metal is injected upward against gravity at a slower speed into the cavity to maintain a laminar flow that progressively fills the cavity. Although squeeze casting is capable of producing parts with improved quality, the cost of squeeze-casting products is very high due to much longer cycle time and substantially shorter die life.

Another casting process, thixocasting is a semi-solid process in which the alloy is pre-cast with electromagnetic stirring to obtain a non-dendritic alloy microstructure and then partially re-melted to a semi-solid state before being injected into the mold cavity. As semi-solid metal has high viscosity, small shrinkage and good fluidity, cast products can be produced with improved near net-shape and less porosity. However, as the cost of the special feedstock and the re-melting process is high, thixocasting is not cost competitive.

Rheocasting is another type of semi-solid casting process in which semi-solid metal with non-dendritic microstructure produced from liquid metal is charged directly into a HPDC press for casting. Conceptually, rheocasting could be a cost-competitive process with good product quality.

However, the latent heat of liquid metal is typically very high. Consequently, the requirement to cool liquid metal quickly into semi-solid status without causing a large temperature difference is rather challenging. As the rheology of semi-solid metal is very sensitive to temperature, the resulting temperature differences in the semi-solid metal could cause unacceptable defects, e.g. cold shot, mend line and porosity. Furthermore, a rheocasting system is very complex and requires possible down time to contain and to transfer the semi-solid metal.

Thixomolding is another semi-solid process in which solid alloy pellets are sheared, melted and transported forward along a heated barrel by a rotating screw. When sufficient material accumulates in the shot chamber, the screw moves forward to inject the molten alloy into a steel mold. Because the screw is exposed to molten alloy at high temperature, thixomolding is not compatible with corrosive alloys, e.g. aluminum. In addition, the quality of thixomolding products are not appreciably better than HPDC, as the injection force for a thixomolding machine is typically lower than that for a HPDC machine with the same clamping force.

Further, for metal-matrix composites, where harder particles, e.g. silicon carbides, are added into lightweight alloys to improve mechanical properties, existing HPDC and squeeze casting processes are unacceptable as the solid particles may have segregated from the alloy matrix due to density difference in the accommodating chamber of a die-casting machine before the composite is injected into the mold cavity.

The use of electromagnetic fields in metal processing, especially in continuous casting, has been explored for many decades.

For example, U.S. Pat. Nos. 2,861,302, 2,877,525 and 3,693,697 taught methods to improve a metal's microstructure in continuous casting by applying stationary, rotating or linearly shifting electromagnetic fields, respectively, to stir liquid metal. In U.S. Pat. No. 4,321,958, a rotating electromagnetic field and a linear electromagnetic field were combined to create a spiral stirring pattern in metal. In U.S. Pat. No. 4,645,534, the electromagnetic field was applied to maintain a sharp interface between two metals cast continuously in an ingot.

U.S. Pat. No. 3,467,166 discloses how to replace a physical casting mold with shaped conducting coils by forming a gap between the coils and the cast ingot with an electromagnetic field. In U.S. Pat. No. 4,678,024, an electromagnetic field is applied to prevent liquid metal from leaking through the gap between two rollers. An electromagnetic field was applied to pump liquid metal in U.S. Pat. No. 4,776,767. In U.S. Pat. No. 4,986,340, an electromagnetic field is applied as a brake to slow down the metal flow for more uniform speed in continuous casting.

U.S. Pat. No. 4,229,210 teaches a method of producing a semi-solid slurry in a crucible through agitation induced by generating an alternating electromagnetic field with a solenoid coil. U.S. Pat. No. 5,579,825 suggests a similar method to produce semi-solid metal in a HPDC machine with a shot chamber that does not allow electric current to circulate. As Winter et. al. pointed out in U.S. Pat. No. 4,434,837, a high-frequency electromagnetic field can only penetrate a small depth into a metal's surface. Hence, induction agitation can only modify the microstructure of alloy near the shot chamber walls. The microstructure of-the alloy beyond the penetration depth remains dendritic, especially for crucible or shot chamber with larger diameter. Furthermore, the high heating energy generated by the eddy current only makes it more difficult to cool the metal from a liquid into a semi-solid state. U.S. Pat. No. 4,434,837 teaches a process to produce semi-solid metal by stirring liquid metal with a rotating electromagnetic field in a crucible under controlled cooling. A similar method was suggested in WO 01/91945 to produce semi-solid metal billets and to transfer the material into the shot chamber of a HPDC machine to produce parts.

As Winter et al. points out in U.S. Pat. No. 4,434,837, the stirring efficiency of the shifting electromagnetic field decreases rapidly as the metal temperature decreases and the corresponding viscosity of the semi-solid metal increases.

In fact, Winter et al. U.S. Pat. No. 4,434,837 reported that the semi-solid metal in the periphery stopped shifting first and that the non-shifting portion gradually propagated toward the center of the casting.

When this method is applied to a rheocasting process, as described in WO 01/91945, it is likely that the colder dendritic metal on the periphery may be injected, along with other metal, into the product cavities and cause defects.

U.S. Pat. No. 6,135,196 is a slurry process in which semi-solid metal is prepared in a first chamber and drawn by a vacuum into a second chamber where a ram injects the slurry into the mold cavity. The disclosed machine is rather complicated and a vacuum may not provide sufficient force to draw a semi-solid metal with high solid fraction from the first chamber into the second.

In U.S. Pat. No. 6,165,411, the slurry preparation was divided into three stages: (1) nucleation of equiaxed crystals by pouring liquid metal into a cup; (2) crystal growth under air cooling and induction heating; and (3) re-melting by induction heating.

BRIEF SUMMARY OF THE INVENTION

One objective of this invention is to homogenize and to control the temperature of the casting materials, which can be many different materials, including liquid metal, semi-solid metal or metal-matrix composite, in the shot chamber of a casting machine before and during the injection process.

Another objective of this invention is to produce semi-solid slurry with homogeneously degenerated microstructure and with uniform temperature from liquid metal directly in the shot chamber of a forming press, regardless of the shot size.

Another objective of this invention is to enable the mixing of liquid metal and solid particles, added into the shot chamber separately, to form a metal-matrix composite and to maintain the homogeneity of the metal-matrix composite in the shot chamber with high shear rate until the injection is completed, even under a slow injection speed.

Another objective of this invention is to prevent the metal near the shot chamber walls from being over cooled before injection into the cavity, even when the injection time is long, e.g. in squeeze casting.

Another objective of this invention is to ensure the efficiency of the electromagnetic effects on the casting material with a shot-chamber design that allow the electromagnetic fields to penetrate.

Another objective of this invention is to achieve the above objectives with a reliable, low-maintenance and compact electromagnetic device that can fit into the limited space around the shot chamber of existing die-casting presses.

In achieving the above objectives, one embodiment of the die-casting process, according to the present invention, includes the following steps: (1) charging material to be cast into the shot chamber of a die-casting machine that has embedded heat-transfer lines; (2) applying at least one low-frequency shifting electromagnetic field to the casting material in the shot chamber; and (3) injecting the material into the cavity. In addition, the method may include the additional step in which at least one high-frequency electromagnetic field is applied to the casting material in the shot chamber simultaneously or sequentially with the low-frequency electromagnetic field before the casting material is injected into the cavities. The chamber may be provided in a vessel.

The temperature of the heat transfer fluid circulating in the shot chamber is controlled to maintain the thermal balance in the shot chamber and, indirectly, to remove heat from the casting material.

The electromagnetic fields are characterized such that the low-frequency electromagnetic fields will cause the gross casting material, especially those in the interior, to flow continuously with high shear rate and vigorous mixing while the high-frequency electromagnetic field will induce agitation, eddy current and electric-resistant heating mainly within the casting material in the periphery near the inner walls of the shot chamber.

In another embodiment of the present invention, the die-casting device includes a melt furnace, a device that transfers melt from the melt furnace into the shot chamber of the casting machine, a casting die, and a casting machine with a shot chamber surrounded by an electromagnetic system.

In another embodiment of the present invention, the device is not limited to use in die-casting applications, but may be used in other material processing applications, where the material being processed may be other than die-casting material and the shot chamber may also be known as a containing chamber.

The shot chamber, which has cooling lines embedded in its walls, is made of a non-magnetic material with wall thickness less than three times the penetration depth of the electromagnetic fields. The electromagnetic system includes at least one electric-motor stator that generates a low-frequency shifting electromagnetic field. The die-casting device may also include at least one solenoid coil that generates a high-frequency alternating electromagnetic field between the shot chamber and the stator. In order to prevent the stator from being over-heated by the high-frequency electromagnetic field, the two electromagnetic devices are separated either by a safety gap or, when the available space is tight, by a conductive shield that only allows the penetration of low-frequency electromagnetic fields.

In another embodiment of the casting device according to the present invention, the shot chamber of the die casting press comprises two co-axial sections: a first section for homogenization and thermal control, and a second section for pressurization and solidification. The two sections have the same internal diameter to allow the plunger to push the casting material from the first section through the second section into the casting cavity. The first section is made of a non-magnetic material with wall thickness equal or less than-three times the penetration depth of the electromagnetic fields, and the second chamber is made of a material with high strength and good thermal conductivity. The first section of the shot chamber is surrounded by the electromagnetic device.

BRIEF DESCRIPTION OF THE SEVERAL VIEWS OF THE DRAWINGS

The objects of the invention are achieved as set forth in the illustrative embodiments shown in the drawings which form a part of the specification.

DETAILED DESCRIPTION OF THE PREFERRED EMBODIMENT

Figure 1:
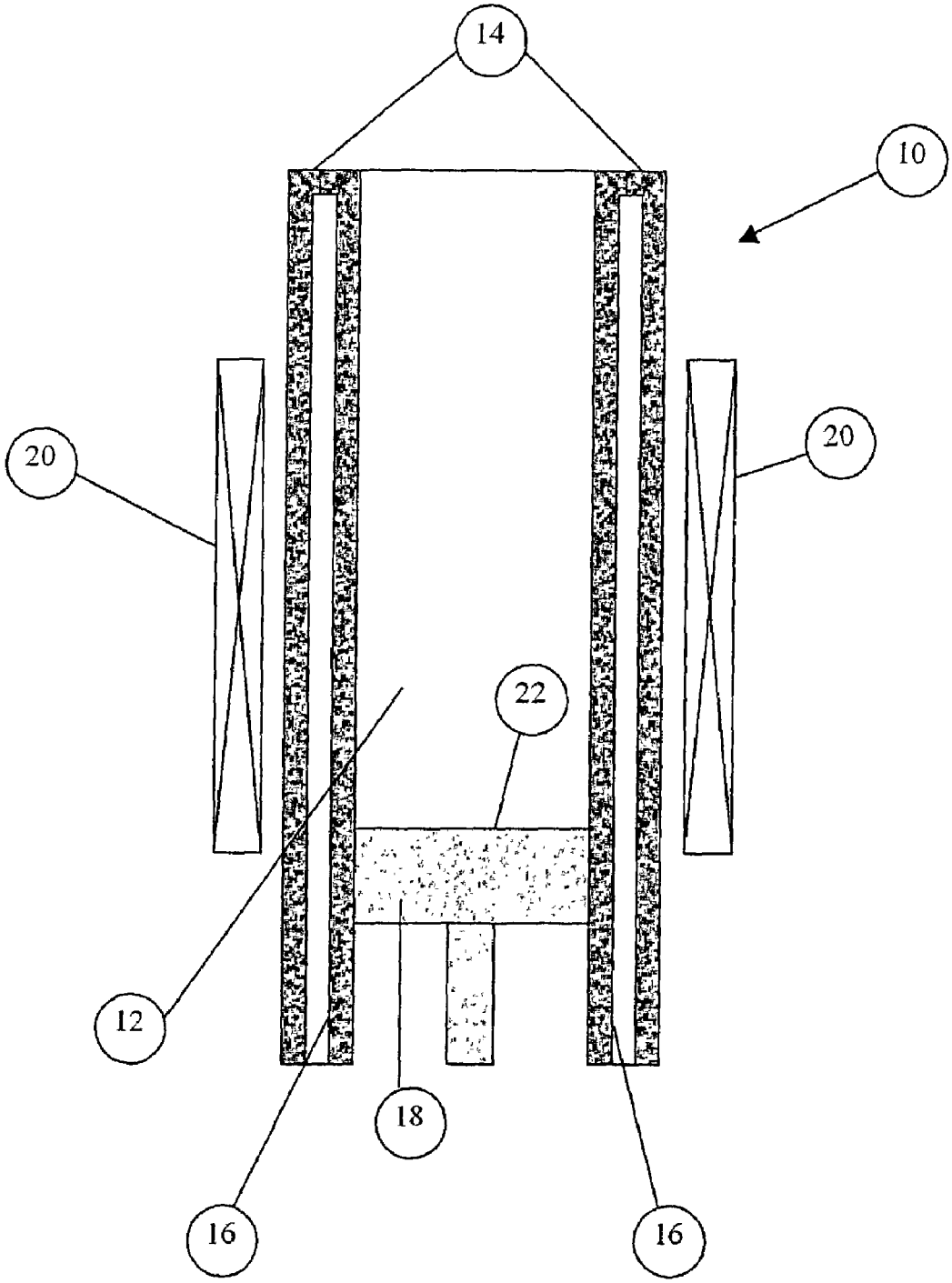
FIG. 1 is a sectional view in schematic form of the shot chamber of a die-casting machine of the preferred embodiment.

The material handling and injection chamber for the novel die-casting machine of the preferred embodiment is indicated generally at 10 (FIG. 1). The die casting machine 10 includes a shot chamber 12 into which casting material is charged, a sleeve 14, heat-transfer-fluid ("HTF") passages 16 which are embedded inside the sleeve 14, a ram 18 and electric motor stators 20 surrounding the chamber sleeve 14. The ram 18 has a frontal face 22 that is directed to the interior of the shot chamber 12, and is capable of being moved within the shot chamber 12 along the inside of the sleeve 14. The volume in the shot chamber 12 is defined by the sleeve 14 and the ram face 22.

During the cyclic casting process, HTF is circulated through the HTF passages 16. Both the temperature and flow rate of the circulating HTF are controlled to maintain a desired thermal balance of the shot chamber 12. Since the temperature of the shot chamber 12 is typically much lower than the temperature of the casting material injected into the chamber, thermal energy will be transferred from the casting material to the shot chamber 12. As a result, there will be an increasing temperature gradient in the casting material proportional to the resident time of the casting material in the shot chamber 12.

In a conventional die casting machine, if the casting material is a composite mixture of a liquid alloy and small solid particles of a hard material, e.g. silicon carbide, undesirable segregation of the materials may occur in the shot chamber before the composite is injected into the part cavities.

In the present invention, however, a shifting electromagnetic field is applied to the casting material in the shot chamber 12 by using the electric motor stators 20. Since the casting material is an electric conductor, an eddy current and the corresponding electromagnetic field will be induced in the body of the casting material in such a direction that it opposes the change of magnetic flux caused by the shifting electromagnetic field. The interaction between the applied shifting electromagnetic field and the induced electromagnetic field will generate a body force on the casting material to cause a motion in the same direction as the applied field moves. As the induced eddy current closer to the surface of the casting material would reduce the net magnetic flux that penetrates into the interior of the casting material, the eddy current density and the corresponding electric-resistant heating and magneto-motive force are highest on the surface of the casting material and decay exponentially inward. Similarly, if the shot chamber of the casting machine is a conductor, the eddy current in the shot chamber will also reduce the net strength of the electromagnetic field applied on the casting material.

The capability of an electromagnetic field to penetrate a cylindrical conductor with circular cross section can be described by a characteristic length called penetration depth, δ, which can be expressed mathematically as $$\delta = \sqrt{\frac{\rho}{\pi \mu f}} \tag{1}$$

where f is the frequency of the electromagnetic field. ρ and $\mu$ denote the electric resistivity and the magnetic permeability of the conductor. Based on the above formula, it is easier for electromagnetic fields to penetrate non-magnetic materials, which have a smaller magnetic permeability, or less conductive material, which has higher electric resistivity. This equation also explains why the conventional shot chamber, made with high-toughness magnetic tool steel, is not applicable with this invention.

Examples of non-magnetic materials that have high electric resistivity and high strength are Co—Cr—Ni alloys, Ni—Cu alloy, Ni—Cr alloy, high nickel iron, high nickel chromium-silicon iron, 300 series stainless steel, and titanium alloys.

Significantly, equation (1) reveals that the penetration depth of an electromagnetic field can be controlled by varying its frequency. Similarly, the wall thickness of a conductor can be designed to either allow a desired amount of the electromagnetic field to penetrate or else to block the electromagnetic field entirely. It should be noted, however, that penetration depth is only a characteristic distance from the conductor's surface where "most", but not all, of the induced current is distributed. At one penetration depth, the magnetic field's strength and the induced current density are about 37% of their surface values and the power density is about 14% of its surface value. At two and three penetration depths, the corresponding current densities are 14% and 5%, respectively. This is significant in determining the appropriate thickness for the shot chamber wall. For example, if the shot chamber wall is thicker than three penetration depths, then the current and power densities on the surface of the casting material would be less than 5% and 0.3% of the current and power densities on the outer surface of the shot sleeve, respectively.

According to the present invention, the shot chamber 12 of a die casting machine in the preferred embodiment is made of a non-magnetic material with wall thickness equal or less than three times the penetration depth of the applied electromagnetic field. The force induced by the electromagnetic field in the casting material can be increased by increasing the field's shifting speed and intensity. The intensity is proportional to the line current, voltage and the number of turns of the windings in the stator. The electromagnetic field can be a field rotating with respect to the central axis of the shot chamber, a linear field shifting parallel to the axis, or a spiral field that has a path similar to the thread of a screw. In addition to electric motor stators, a shifting electromagnetic field can also be generated by the movement of a permanent magnet. With the above embodiment of the present invention, the temperature gradient of the casting material in the shot chamber 12 of a die casting machine can be reduced.

Liquid metal and solid particles can be added separately and mixed in the shot chamber 12 to produce composite parts quickly and economically. Segregation of the premixed composite material in the shot chamber 12 can also be prevented.

Although the preferred embodiment is effective to improve the homogeneity and thermal uniformity of the casting material, there may still be problems for semi-solid casting. It is well known that, even with electromagnetic stirring, the alloy billet cast in a continuous process for semi-solid casting still has a dendritic skin. As Winter et. al. U.S. Pat. No. 4,434,837 pointed out, as the temperature of the alloy in the periphery decreases rapidly below its liquidus temperature and the viscosity of the alloy increases so much that the electromagnetic force simply could not stir the alloy continuously.

Figure 2:
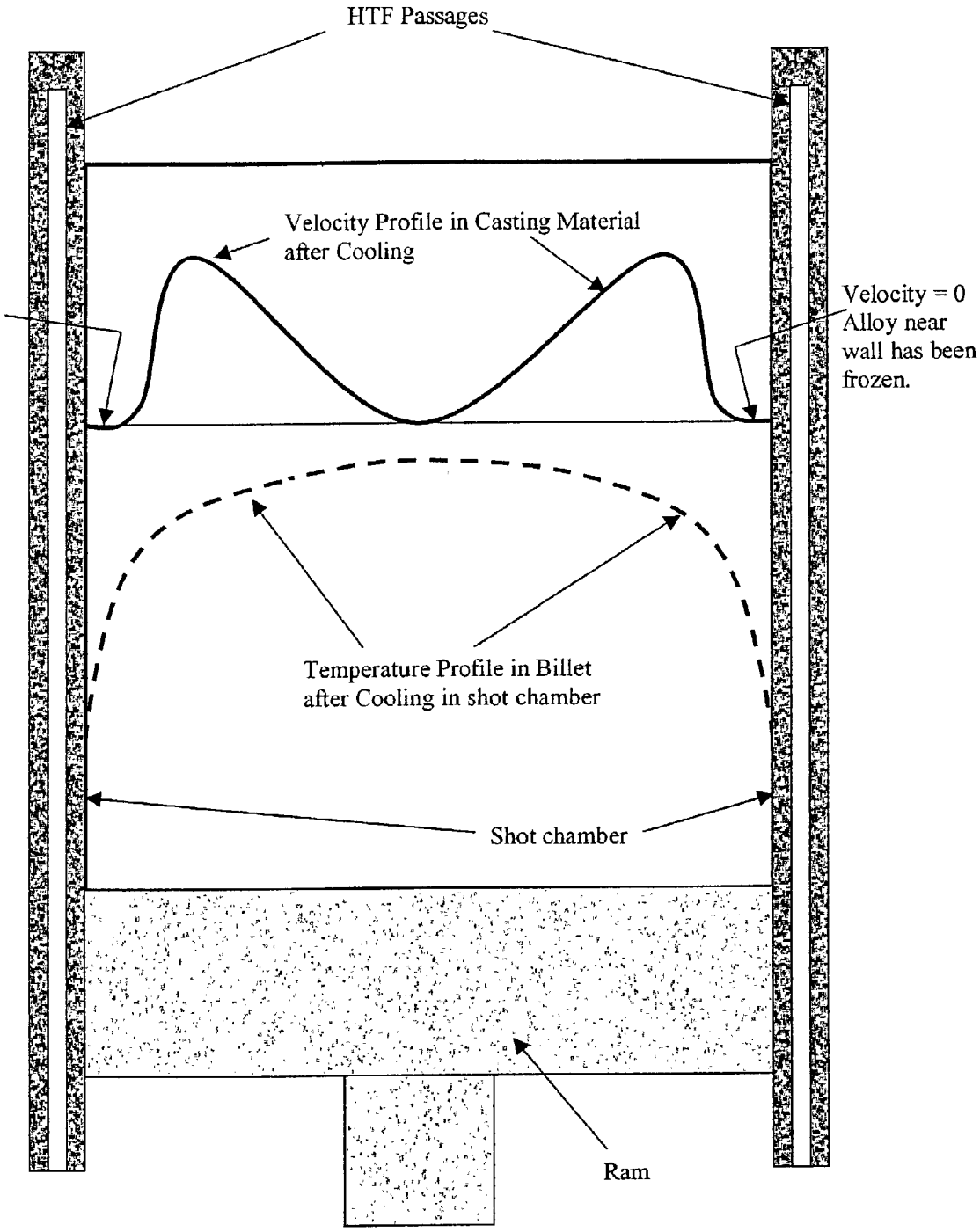
FIG. 2 is a sectional view in schematic form of the temperature and velocity profiles in the middle section of the casting material inside the shot chamber of the preferred embodiment after the thermal energy of the casting material has been absorbed by the shot chamber walls.

FIG. 2 shows the schematic temperature and velocity profiles of a semi-solid metal that is cooled and stirred by an electromagnetic field in the shot chamber of a die casting machine. Although the metal in the central region is still hot enough to sustain acceptable fluidity, the temperature in the peripheral layer has dropped much lower and the corresponding viscosity is much higher. Within a short time, a layer of the metal near the shot chamber's wall will solidify and be incapable of flow. Only the material in the central region will continue to flow under the magneto-motive force induced by the shifting electromagnetic field.

Without effective stirring, the temperature in the peripheral layer will continue to decrease rapidly and cause quality problems, such as cold shot, cracks or porosity, in the parts. Similar problem can also occur in squeeze casting because of the relatively slower injection speed.

Figure 3:
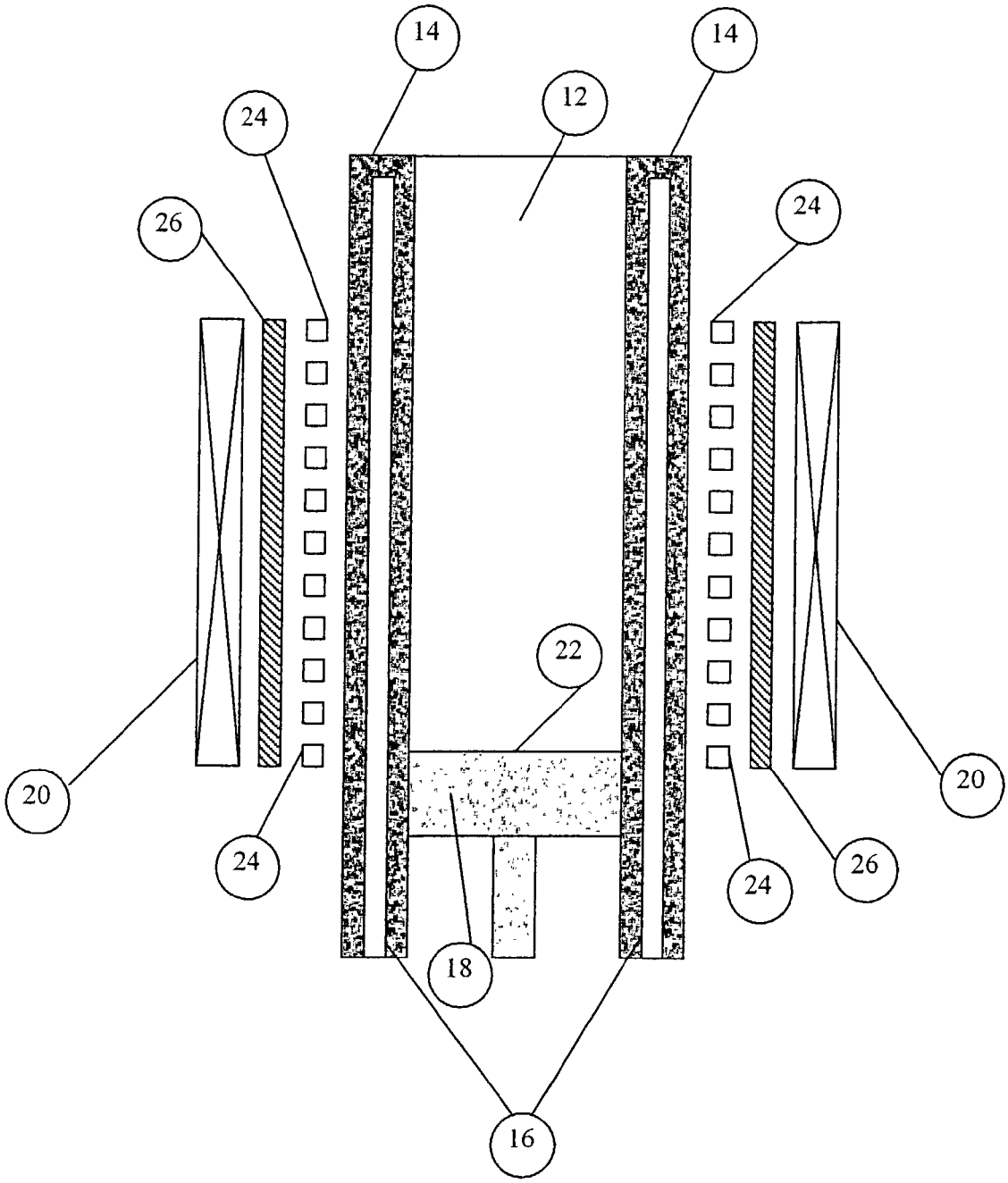
FIG. 3 is a sectional view in schematic form of the shot chamber of a diecasting machine of another embodiment of the present invention.

This problem in such applications can be overcome by another embodiment of the present invention as shown in FIG. 3. In this second embodiment, a solenoid coil 24 is placed between the stators 20 and the shot chamber 12. The coil 24 generates an alternating high-frequency electromagnetic field that will induce an eddy current, agitation and electric-resistant heating in the peripheral layer of the casting material in the shot chamber 12. Hence, in a casting process according to the present invention, after a liquid or semi-solid metal is charged into the shot chamber 12, the casting material will be cooled and stirred by the shifting electromagnetic field generated by the stators 20.

Figure 4:
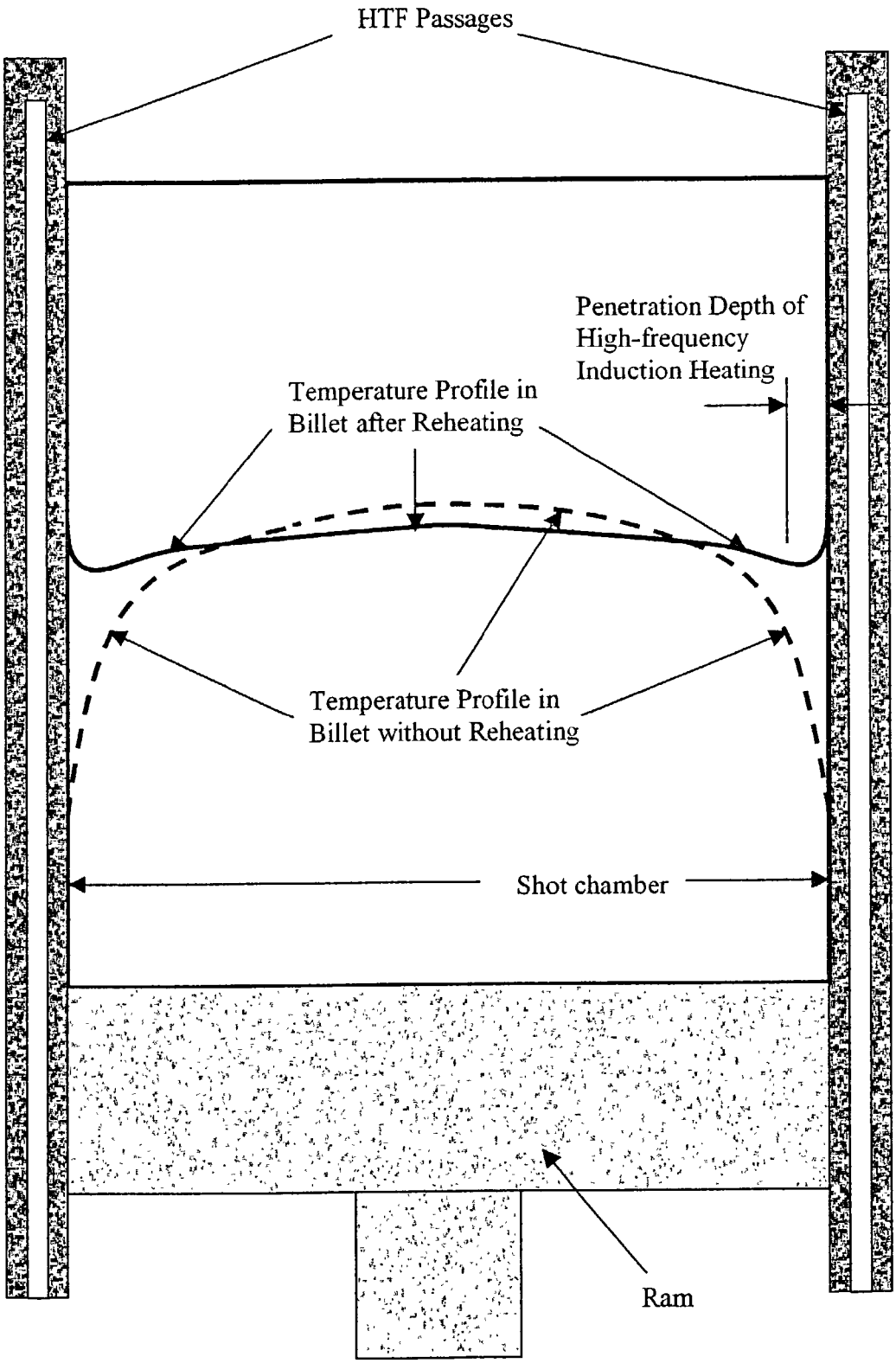
FIG. 4 is a sectional view in schematic form of the temperature profiles in the middle section of the casting material inside the shot chamber before and after induction heating is applied.

The cooling rate of the casting material is controlled by the temperature and flow rate of the HTF circulating in the passages 16 embedded in the chamber sleeve 14 and by applying the induction heating at zero or an otherwise low power. When the temperature of the casting material in the central region cools to the target temperature range, the induction power is increased to raise the corresponding temperature of the material in the peripheral layer. In FIG. 4, a comparison of the schematic temperature profile before and after the induction heating is applied, it can be seen that by selecting an appropriate frequency for the induction-heating electromagnetic field, one can control the penetration depth of the eddy current to heat only the material in the peripheral layer where the temperature is too low.

In addition to heating, the induction electromagnetic field also generates a high-frequency pulsating squeezing force on the material in the peripheral layer to modify its dendritic microstructure. As is readily apparent to one of ordinary skill in the art, utilizing this second embodiment, a semi-solid metal can be produced from liquid metal with uniformly degenerated microstructure and minimum temperature difference, regardless of the shot size, in the shot chamber 12 of a die-casting machine quickly and economically to produce metal parts with high quality.

It is also well known in the art that the available space around the shot chamber of a die casting machine can be very limited. Hence, there may not be enough space available to adequately separate the stator 20 and the solenoid coil 24. If the distance is too small, the stator 20 could be over-heated by the high-frequency electromagnetic field generated by the solenoid coil 24. In order to isolate the stator 20 from the high-frequency electromagnetic field, a conducting shield 26 separates the stators 20 from the coil 24 in the second embodiment (FIG. 3). The shield 26 is made of a non-magnetic conducting material. With appropriate shield thickness, an eddy current induced in the shield 26 will cancel the transmission of the high-frequency electromagnetic field generated by the solenoid coil 24 and allows only the lower-frequency shifting electromagnetic field generated by the stator 20 to penetrate.

The electromagnetic field for stirring has a lower frequency and a larger penetration depth, $\delta_{low\text{-}freq}$. The electromagnetic field for induction heating has a higher frequency and a smaller penetration depth, $\delta_{high\text{-}freq}$.

By having distinctly high and low frequencies between the electromagnetic fields and a shield 26 with thickness between $\delta_{low\text{-}freq}$ and $\delta_{high\text{-}freq}$, most of the high-frequency electromagnetic field for induction heating can be filtered by the shield 26 while the low-frequency electromagnetic field for stirring can still penetrate the shield to reach the casting material in the shot chamber 12.

Figure 5:
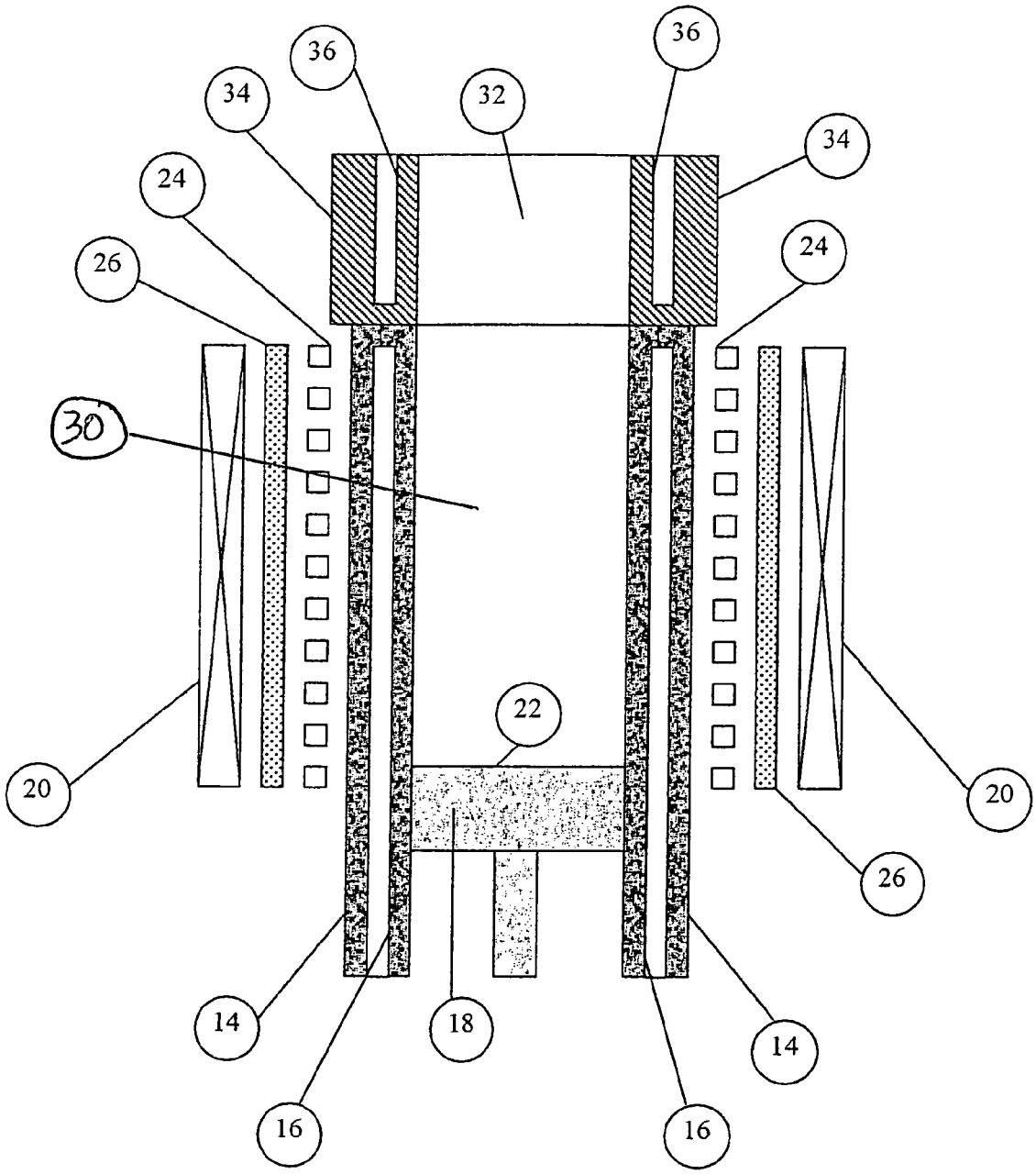
FIG. 5 is a sectional view in schematic form of the shot chamber of a die-casting machine of the preferred embodiment with a two-section co-axial shot chamber, where one section of the shot chamber is surrounded by the electromagnetic devices and shield.

FIG. 5 is yet another embodiment of the present invention. In this third embodiment, the shot chamber 12 has been divided into two coaxial sections, a first section 30 and a second section 32, positioned in sequence between the ram 18 and the die (not shown). The first section 30 is located near the ram 18, and is utilized for mixing and temperature control of the casting material as described in the first two embodiments of the present invention. The second section 32 is constructed with walls 34 having integral HTF passages 36.

Typically, when casting material is injected from the shot chamber into the part cavities, the pressure on the casting material is relatively low as the part cavity fills, even if the injection speed is high. Therefore, the stress on the first section 30 of the shot chamber is typically lower than the stress in the second section 32.

After most of the casting material is injected to fill the part cavities, the second section 32 will accommodate the remaining casting material under high pressure applied by the ram 18 to squeeze more material into the cavities and thereby suppress the possible formation of shrinkage porosity.

Such high pressure will cause a high stress in the second section 32 of the shot chamber 12. Since the high pressure only exists in the second section 32 where electromagnetic stirring or induction heating is not required, the second section 32 can be made of a material, magnetic or non-magnetic, with high strength and high thermal conductivity, and constructed with a thick wall. As disclosed in the preferred embodiment of the present invention, the first section 30 should be made of non-magnetic material with wall thickness less than three times the penetration depth of the applied electromagnetic fields.

Having thus described the invention, what is claimed and desired to be secured by Letters Patent is:

1. A die casting method, said method comprising:

a. loading an electrically conducting casting material into a shot chamber having walls made of non-magnetic material;

b. applying a shifting electromagnetic field to the casting material, said shifting electromagnetic field having a known penetration depth relative to the shot chamber; and c. charging the casting material from the shot chamber into a desired part cavity;

wherein the penetration depth of said shifting electromagnetic field is equal to or greater than about one third of the wall thickness of the shot chamber.

2. The method of claim 1, wherein the casting material is liquid.

3. The method of claim 1, wherein the casting material is semi-solid.

4. The method of claim 1, wherein the casting material includes molten metal and solid particles.

5. The method of claim 4, wherein the molten metal and solid particles are pre-mixed before being charged into the shot chamber.

6. The method of claim 1, further comprising the step of applying heat to the casting material.

7. The method of claim 6, wherein the heat is generated by applying an alternating electromagnetic field to the casting material.

8. The method of claim 7, wherein the alternating electromagnetic field has a higher frequency than the shifting electromagnetic field.

9. The method of claim 8, wherein the alternating electromagnetic field is applied after the temperature in the central region of the casting material has cooled in the shot chamber to a target temperature.

10. The method of claim 7, wherein the frequency of the alternating electromagnetic field is selected so as to concentrate most of the induced heat at a target depth within the casting material.

11. The method of claim 10, wherein the casting material is forced from the shot chamber once the temperature of the casting material near the walls of the shot chamber is re-heated to a target temperature.

12. The method of claim 1, wherein the shot chamber is cooled by a heat-transfer-fluid.

13. The method of claim 12, wherein the heat-transfer-fluid is circulated through one or more passages embedded in the wall of the shot chamber.

14. The method of claim 1, wherein the shifting electromagnetic field rotates about a selected axis of the shot chamber.

15. The method of claim 1, wherein the shifting electromagnetic field shifts linearly along the length of a selected axis of the shot chamber.

16. The method of claim 1, wherein the shifting electromagnetic field has a spiral trajectory along a length of a selected axis of the shot chamber.

17. The method for die casting of claim 1 and further including providing a second section of the shot chamber made of magnetic or nonmagnetic material or a thickened wall to accommodate any casting material remaining and subjecting it under high pressure after the cavity is filled.

18. A die casting method, said die casting method providing for material processing comprising:

a. providing a containing chamber defined by a sleeve made of nonmagnetic material surrounding the containing chamber; and b. providing a first electromagnetic field generator in proximity to the sleeve, and operating said first generator to generate a shifting electromagnetic field with a penetration depth to equal to at least one-third of the thickness of the sleeve.

19. The method for material processing of claim 18, and further comprising providing a movable ram positioned in the chamber for forcing material into the chamber while a shifting electromagnetic field is applied to the material by operation of the first generator to mix and prepare the material for processing, whereupon advancing the ram within the sleeve forces the material from the chamber.

20. The method of material processing of claim 19, and further comprising providing a second electromagnetic field generator, positioning said generator between the sleeve and the first electromagnetic field generator, and operating said second generator to apply an alternating electromagnetic field to the material with a frequency higher than that produced by said first generator, so as to induce heating of the material in the chamber.

21. A method for material processing of claim 20, and further comprising providing an electromagnetic shield, positioning said shield between the first and second electromagnetic generators, and operating said shield to allow for material-shifting electromagnetic fields to penetrate from the first generator into the chamber while shielding the first generator from the second generator's higher frequency electromagnetic field.

* * * * *